US007249630B2

(12) United States Patent
Wardlaw

(10) Patent No.: US 7,249,630 B2
(45) Date of Patent: Jul. 31, 2007

(54) WELL TOOL AND METHOD FOR HEATING AND DEPOSITING FIRST AND SECOND CHARGES OF SELECTIVE TEMPERATURE MELTING METAL ALLOYS FOR REPAIRING FAILURE SPOTS ALONG A SECTION OF A TUBULAR CONDUIT IN A SUBTERRANEAN WELL

(75) Inventor: Louis J. Wardlaw, Houston, TX (US)

(73) Assignee: Cinaruco International S.A. Calle Aguilino de la Guardia, Panama I (PA)

( * ) Notice: Subject to any disclaimer, the term of this patent is extended or adjusted under 35 U.S.C. 154(b) by 0 days.

(21) Appl. No.: 10/924,056

(22) Filed: Aug. 20, 2004

(65) Prior Publication Data

US 2006/0037749 A1 Feb. 23, 2006

(51) Int. Cl.
*E21B 29/00* (2006.01)
*E21B 36/00* (2006.01)

(52) U.S. Cl. ..... 166/277; 166/302; 166/58

(58) Field of Classification Search ..... 166/277, 166/302, 58, 57, 256; 175/11, 14
See application file for complete search history.

(56) References Cited

U.S. PATENT DOCUMENTS 4,275,788 A * 6/1981 Sweatman ..... 166/292
5,137,283 A * 8/1992 Giarrusso et al. ..... 277/312
6,923,263 B2 * 8/2005 Eden et al. ..... 166/288
6,926,083 B2 * 8/2005 Larovere ..... 166/302
6,942,032 B2 * 9/2005 La Rovere et al. ..... 166/288
2004/0149443 A1 * 8/2004 La Rovere et al. ..... 166/302
2005/0109511 A1 * 5/2005 Spencer ..... 166/302
2005/0284636 A1 * 12/2005 La Rovere et al. ..... 166/302

* cited by examiner

*Primary Examiner*—Jennifer H Gay
*Assistant Examiner*—Nicole A Coy
(74) *Attorney, Agent, or Firm*—Beirne Maynard & Parsons L.L.P.

(57) ABSTRACT

A well tool and method for heating and depositing first and second charges of selective temperature melting metal alloys for repairing failure spots along a section of a tubular conduit, such as casing, in a subterranean well. A fuel charge is provided and is ignited to first melt the lower temperature melting metal alloy charge and thereafter the higher temperature metal alloy charge, such that a metal precipitate is formed from the heated higher temperature melting metal alloy charge. The housing defines a sacrificial wall which is opened or cleared as the higher temperature metal alloy charge melts, thus enabling the precipitate of the higher temperature melting alloy charge to be discharged from the housing to form a bridge for subsequent movements thereacross of the lower temperature melting alloy charge, into the well immediate the area of the failure spots. The failure spots are filled and/or covered by the precipitate and the lower temperature metal alloy charge to enhance the integrity of the tubular conduit such that production or other efforts may be continued within the well.

6 Claims, 2 Drawing Sheets

WELL TOOL AND METHOD FOR HEATING AND DEPOSITING FIRST AND SECOND CHARGES OF SELECTIVE TEMPERATURE MELTING METAL ALLOYS FOR REPAIRING FAILURE SPOTS ALONG A SECTION OF A TUBULAR CONDUIT IN A SUBTERRANEAN WELL

BACKGROUND OF THE INVENTION (1) Field of the Invention

The invention relates to an apparatus and method for the repair of failure spots along a first tubular conduit, such as casing, in a subterranean well.

(2) Brief Description of the Prior Art

Subterranean wells, such as oil, gas or water wells, oftentimes are completed with the introduction and cementing in place a long string of tubular sections of metallic casing. Since the expected production life of such a well has been known to last decades, and in view of the fact that the abrasive well fluids and treatment chemicals flowing interiorally of the casing often result in defects, such as small holes, pock marks leading to small holes and cracks, ("failure spots") it is not at all surprising that a failure in circulation of the fluids oftentimes results, with the holes eventually getting larger and larger and even penetrating through the cement securing the casing within the well. It is therefore necessary from time to time to inspect the casing for such defects and attempt to repair them, as opposed to retrieving the entire casing string and running and setting another string of casing.

The present invention addresses the problems as set forth above.

SUMMARY OF THE INVENTION

The present invention provides a well tool and method for heating a low and higher temperature melting metal alloy charge for the repair of failure spots along a section of a first tubular conduit, such as, for example, casing. The well tool comprises an elongated housing having a cylindrical interior chamber and a lower end. The chamber is formed by first and sections therein. The housing also has proximate its lower end a circumferentially extending dissolvable sacrificial wall means for initially isolating the chambers from the exterior of the housing and, upon melting of the metal alloys, providing a passageway through the housing to permit the alloys to flow out of the housing and into the well. A first, low temperature melting eutectic metal alloy charge is deposited within one of the first and second sections of the chamber. A second, higher temperature melting metal alloy charge is deposited within the other of the first and second sections of the chamber. The second, higher temperature metal alloy charge produces, upon melting, a metal precipitate, which, in turn, is used, in combination with the first metal alloy charge, to repair the failure spots, as hereinafter described. Means are provided at one end of the housing for introducing, positioning and retrieving the tool within the well. An ignitable fuel system is also carried within the chamber. Finally, means for igniting the fuel system is provided, whereby, upon activation of the igniting means, the fuel system is ignited sufficient to heat and melt the first lower temperature melting eutectic metal alloy charge and thereafter sufficient to heat and melt the second higher temperature melting metal alloy charge to produce the metal precipitate, such as iron, whereby, upon said melting of said alloy charges, the sacrificial wall is dissolved to provide said passageway for the flow of the first metal alloy and the precipitate through the housing and into the well.

The tool and method of its use further includes a number of additional features and steps, provided by other elements. For example, the tool may include a ceramic or other heat resistant plug carried on said well tool at the lower end of the housing and positionable within the well for bridging the failure spots on the tubular conduit. Upon completion of the operation and method, the plug is caused to be separated or released from the housing, and the housing is retrieved to the top surface of the well and the plug is left in position within the well.

DESCRIPTION OF THE PREFERRED EMBODIMENTS

Figure 1:
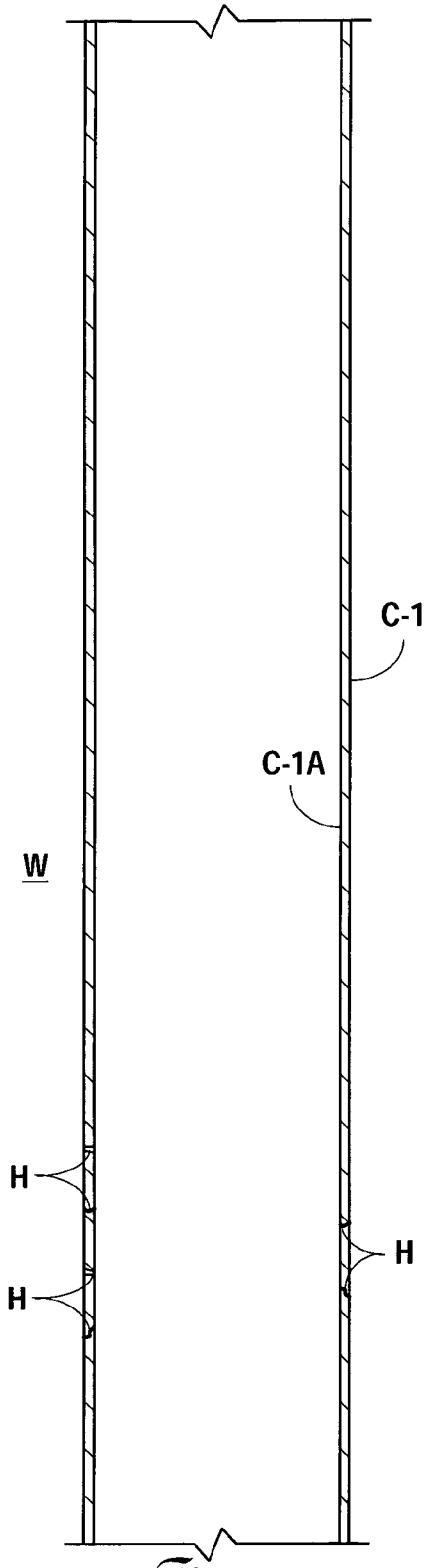
FIG. 1 is a vertical longitudinal sectional schematic view of a section of casing including failure spots to be repaired.

Now referring to FIG. 1, there is shown a subterranean well W. The well W includes previously run and set a first conduit string or casing C-1. As shown the casing string C-1 has a series of small holes or defects H located longitudinally and radially around a section of the casing C-1.

Figure 2:
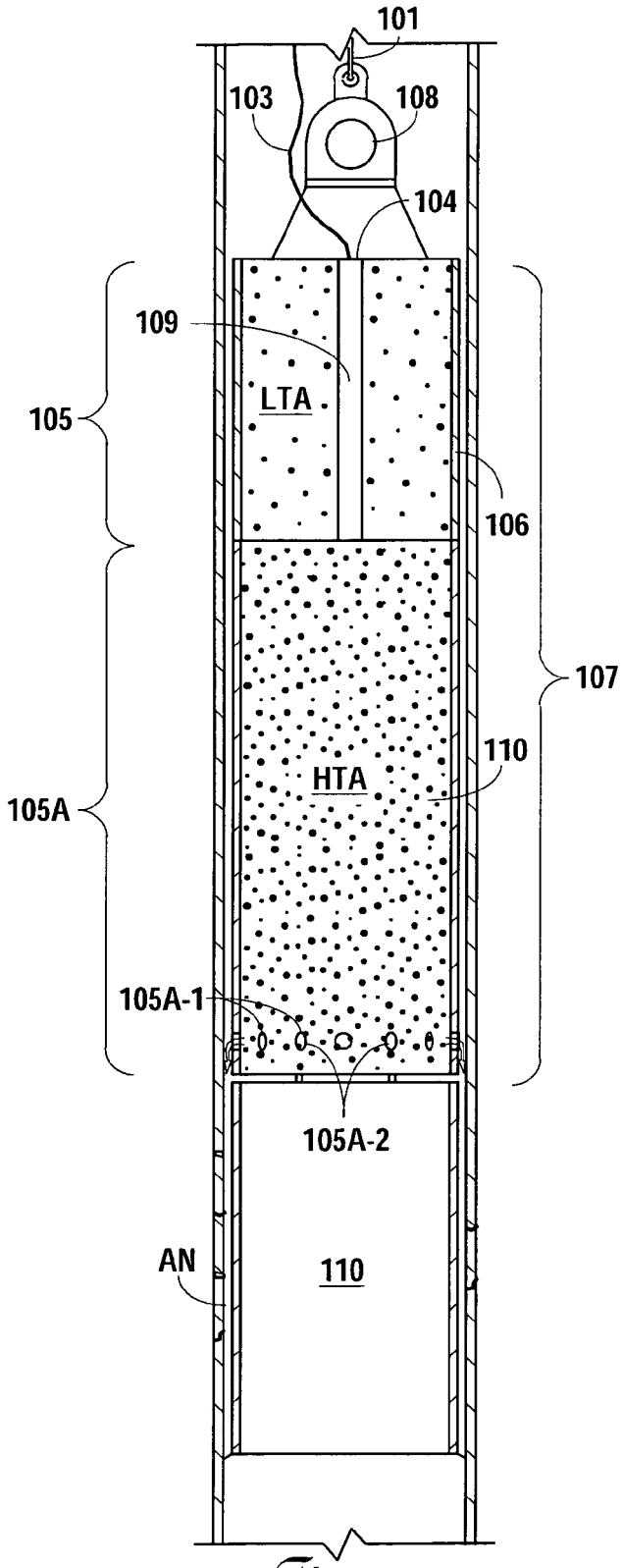
FIG. 2 is a view similar to that of FIG. 1, illustrating the insertion of the well tool of the present invention with a plug having retainer seal disposed at its lower end to form an annular area between the first conduit or casing conduit and the exterior of the plug.
Figure 3:
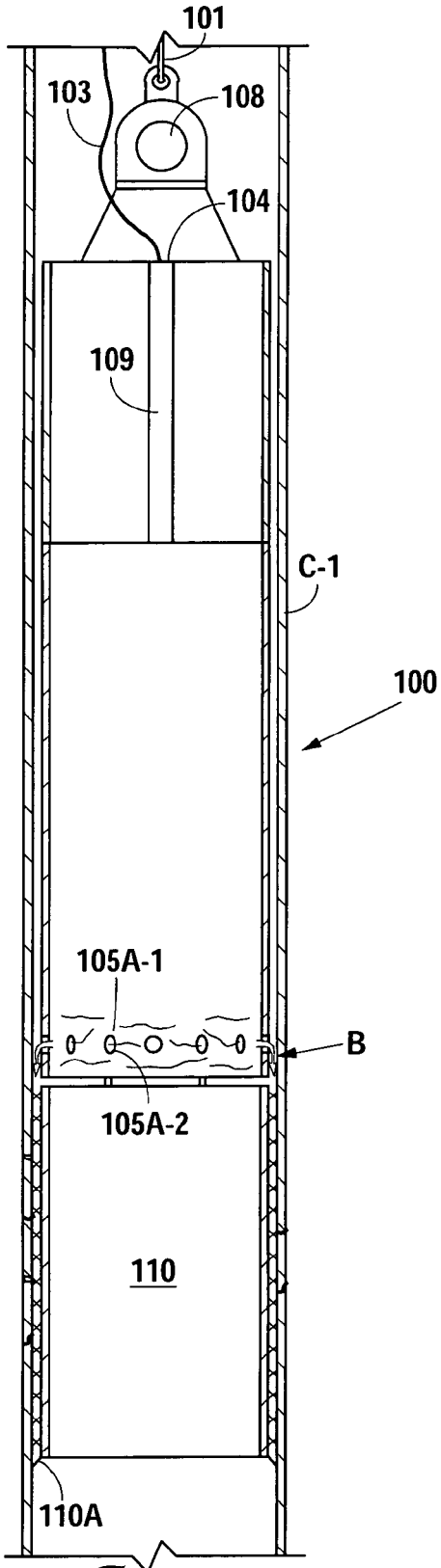
FIG. 3 is an illustration similar to that of FIGS. 1 and 2, and depicting the opening of the sacrificial wall after activation of the tool to melt the metal alloys and provide the metal precipitate and permit the precipitate of the high temperature metal alloy to flow through the passageway provided by the opening of the wall, providing a bridge for flow of the lower temperature melting alloy to seek, fill and cover the failure spots.
Figure 4:
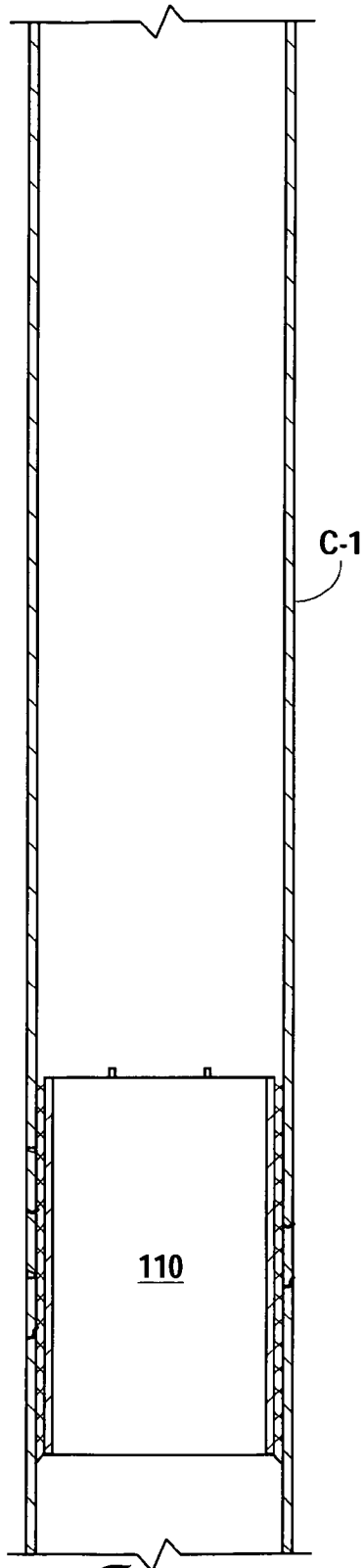
FIG. 4 is an illustration similar to that of FIG. 1, illustrating the repaired casing conduit after the well tool housing has been retrieved, the failure spots repaired, and the plug remaining in place.

As shown in FIG. 2, the apparatus 100 of the present invention is preferably run into the well W on wire line 101, of conventional and known nature. Alternatively, it may be run into the well W on tubing or electric line. If means other than electric line are used to run and set the apparatus 100, an electric line 103 is provided form the top of the well W and connected to a source of electric energy at the top or other location in the well W and is connected at the lower end to an electric starter charge 104 within an upper chamber section 105 within an elongated housing 106. The housing preferably is made of metal, such as an alloy steel or the like. The chamber section 105 is the uppermost portion of a continuing cylindrical interior chamber 107 defined within the interior of the housing 106. A one-way check valve 108 is positioned at the upper end of the housing 106 to vent pressure exceeding a pre-set limit within the housing 106 during ignition of the ignition fuel charge required to activate the apparatus 100. The chamber 107 also has a lower chamber section 105A including a section of a circumferentially extending dissolvable sacrificial wall means 105A-1 for initially isolating the chamber 107 from the exterior of the housing 106, and, upon melting of the metal alloys, providing a passageway 105A-2 (FIG. 3) for flow of the metal alloys into the well W. A ceramic, or other high temperature resistant plug 110 is secured, but selectively removable from, the lowermost end of the housing 106, by means of shear pins 105A-2. At the lowermost end of the plug 110 is a circumferentially extending exterior elastomeric seal means 110A which, when the apparatus 100 is positioned within the well W for operation, will define an annulus area AN between the exterior of the plug 110 and the interior wall or surface C-1A of the casing C-1.

The chamber 107 within the housing 106 contains a homogeneous stabilized ignition or fast burning fuel charge 109. Any commercially available source of a mixture of iron oxide and aluminum, which is used in, for example, explosives for perforating guns or like actuations within a subterranean well, may be used. Additives which assist in the burning of a material under water, such as boron nitrate may also be added. The fuel charge 109 may also include an additive such as magnesium for more controlled burning. The aluminum may be finely ground to increase the rate of burn. However, it is preferable to retard the bum rate of this fuel 109 so that energy is not lost in the exhaust. To control the rate of burn of the fuel 109 to achieve maximum burn without excessive exhaust loss, a binder, such as starch, may be added to slow the rate of burn, as well as an additive that expands upon heating to raise the melting point of the fuel mixture charge 109 and to permit the fuel charge 109 to harden quickly as it is introduced into the housing 107. Such expansion and hardening agents are commercially available from a host of sources and are well known to those skilled in the fuel composite arts for well tool usage.

The invention contemplates use of two metal alloy substances, or charges, for providing the molten metal composite and precipitate for repair of the failure spots H in the well W. The first, or lower temperature melting eutectic metallic alloy LTA is deposited into the first, or uppermost chamber section 105 above the uppermost end of a second, higher temperature melting metal alloy HTA housed within chamber section 105A. The eutectic composition LTA is an alloy, which, like pure metals, has a single melting point. This melting point is usually lower than that of any of the constituent metals. Thus, for example, pure Tin melts at 449.4 degrees F., and pure Indium melts at 313.5 degrees F., but combined in a proportion of 48% Tin and 52% Indium, they form a eutectic which melts at 243 degrees F. Generally speaking, the eutectic alloy composition LTA of the present invention will be a composition of various ranges of Bismuth, Lead, Tin, Cadmium and Indium. Occasionally, if a higher melting point is desired, only Bismuth and Tin or Lead need be used. The chief component of this composition EC is Bismuth, which is a heavy coarse crystalline metal that expands when it solidifies. Water and Antimony also expand but Bismuth expands much more than the former, namely 3.3% of its volume. When Bismuth is alloyed with other materials, such a Lead, Tin, Cadmium and Indium, this expansion is modified according to the relative percentages of Bismuth and other components present. As a general rule, Bismuth alloys of approximately 50 percent Bismuth exhibit little change of volume during solidification. Alloys containing more than this tend to expand during solidification and those containing less tend to shrink during solidification. After solidification, alloys containing both Bismuth and Lead in optimum proportions grow in the solid state many hours afterwards. Bismuth alloys that do not contain Lead expand during solidification, with negligible shrinkage while cooling to room temperature. In summary, when reference herein is made to a low temperature alloy composition, or "a first, lower temperature melting eutectic melting metal alloy", I mean to refer to these exemplary compositions and to metallic compositions which melt at temperatures of no more than about 1,100 degrees F.

Most molten metals when solidified in molds or annular areas shrink and pull away from the molds or annular areas or other containers. However, eutectic fusible alloys expand and push against their container when they solidify and are thus excellent materials for use as plugging agents for correcting failure spots in well tubular conduits, such as casing.

The second, higher temperature elting alloy HTA is deposited within the chamber section 105A. Such alloy composition will melt at temperatures of about 2,400 degrees F., and greater, to form a metal precipitate, such as iron. Modem high temperature alloys have undergone little change in chemical composition in the past thirty years. Most possible combinations of iron, nickel, cobalt, chromium, molybdenum, tungsten, titanium, aluminum, colombium and trace elements have been produced and are available from a number of commercial sources which form a precipitate upon melting:

1. Iron-Base Alloys—This group comprises the low chromium alloys such as 3Cr-1Mo-V, 4340 alloy, AerMet® 100 alloy and Maraging 250, to the 12% chromium, martensitic stainless steels which include 636 alloy, Greed Ascology (AMS 5616), H-46, Jethete M152, FV535 and 355.

The latter group is sometimes referred to as Super 12 Chrome steels with refractory elements such as molybdenum and tungsten to provide greater strength at elevated temperatures. Other minor element additions such as vanadium, columbium and nitrogen are also made for strengthening purposes. The iron-base, low-chromium, marten-sitic steels can be used at temperatures up to 750° F. (400° C.) while the 12% chromium martensitics may be used at temperatures up to 1200° F. (650° C.), but provide only moderate strength above 1000° F. (540° C.).

Other grades in this group include the more highly alloyed exhaust valve steels such as AMS 5700 (aircraft) and the 21–23% chromium manganese alloys with the commercial designations 21-2N, 21-4N, 21-12N and 23-8N. The latter three grades are age hardenable. The age hardening, engine valve type grades are used up to 1400° F. (760° C.), but provide fairly low strength at the upper end of their temperature capability.

2. Iron-Nickel Base Alloys—Both non-age hardenable land age harden-able grades are included in this category. Type 330 stainless and N-155 are examples of solid solution-strengthened (non-age hardenable) alloys.

Age hardenable grades include Pyromet® alloys A-286, 901, V-57, 706, CTX-1, CTX-909 and Thermo-Span® alloy. All of these alloys contain columbium and/or titanium, and aluminum to promote age hardening. Good strength and hardness are obtained in the 1100° F. (595° C.) to 1300° F. (705° C.) range when these alloys are solution treated and aged.

3. Nickel-Base Alloys—These alloys contain more nickel than iron. Chromium is in the range of 20%, and nickel ranges between 50 and 80%. Other alloying elements include molybdenum, tungsten, aluminum, titanium, columbium, cobalt and boron.

This group includes both age hardenable grades and solid solution-strengthened grades (non-age hardenable). Typical of the age hardenable alloys are: Waspaloy, M-252 and Pyromet alloys 41, 80A, 718, 90, X-750 and 751, which are used at temperatures up to 1600° F. (870° C.). Solid solution-strengthened grades (Pyromet alloys 102, 680 and 625) see service at temperatures up to 2200° (1205° C.), where precipitation strengthening is no longer useful.

4. Cobalt Base Alloys—Typical of this category is L-605 alloy which contains 50% cobalt in addition to nickel, iron, chromium and tungsten. It is a ductile alloy suitable for service up to about 1900° F. (1040° C.). Other examples include MP159 and 188 alloys. Metals in this group are particularly useful in sulfur-bearing environments where nickel-base alloys are readily attacked.

OPERATION

Now, with first reference to FIG. 1, there is shown a well W with casing string C-1, containing defects H. Subsequent to the type and depth of the defects H being found in the string C-1, the apparatus 100 of the present invention is run into the well W on wire line 101 or other means well known to those skilled in the art to a depth whereby the ceramic plug 110 straddles or covers all of the defects or failure spots H. The tool or apparatus 100 contains within the chamber 107 the high temperature metal alloy fuel composition charge HTA (chamber section 105A) and the lower temperature eutectic metal alloy charge LTA, thereabove (chamber section 105). The tool 100 is activated by electric activation through electric signal in electric line 103 to activate the fuel charge 109. The tool 100 may also be activated by a number of other known means. Such as by percussion means, or the like. The temperature in the chamber 107 will increase quickly and upon the chamber 107 being heated to a temperature in excess of about 1,100 degrees F. i.e. the melting point for the low temperature eutectic metal alloy charge LTA, the charge LTA will become molten. As the temperature within the chamber 107 increases during the burning of the fuel 109, the melting point of the second or higher melting point metallic charge HTA will be reached and melting of the HTA charge will be initiated, to form the precipitate. Substantially concurrently, the sacrificial wall portions 105A1 of the housing 106 will also melt to cause an opening in the housing 107 and to provide a passage way into the annulus AN for, first, the precipitate of the higher temperature metal alloy charge HTA and thence the lower temperature metal alloy charge LTA. As the precipitate of the high temperature metal alloy charge HTA enters the annular area, it will begin to cool, forming a bridge B over which the lower temperature melting eutectic alloy charge will travel. Both charges HTA (precipitate) and LTA will flow or gravitate within the annular area AN and find and seek the failure spots H in the casing string C-1 and fill and/or cover them. When the procedure is complete, the wire line 101 is pulled at the top of the well W, shearing the pins 105A2 and releasing the housing 106 from the ceramic plug 110. The plug 110 will now remain in the well W, and the well W may be produced, or otherwise operated, as desired.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A well tool for heating a first lower temperature melting eutectic metal alloy charge and a second higher temperature metal alloy charge and for providing from the heated second higher temperature metal alloy charge a metal precipitate for deposition with the first lower temperature melting eutectic metal alloy charge in the well for the repair of failure spots along a section of a tubular conduit, comprising:

(a) an elongated housing having a cylindrical interior chamber and a lower end, said chamber being formed by first and second sections thereof, said housing having proximate its lower end a circumferentially extending dissolvable sacrificial wall means for initially isolating the chambers from the exterior of the housing and, upon melting of the metal alloys, providing a passageway through said housing to permit the metal precipitate to flow out of the housing and into the well;

(b) the first, lower temperature melting eutectic metal alloy charge deposited within one of the first and second sections of the chamber;

(c) the second, higher temperature melting metal alloy charge deposited within the other of the first and second sections of the chamber;

(d) means at one end of said housing for introducing, positioning and retrieving said tool within said well;

(e) an ignitable fuel system within said chamber;

(f) means for igniting the fuel system, whereby, upon activation of the ignitable fuel system, the fuel system is ignited sufficient to heat and melt the first lower temperature melting eutectic metal alloy charge and thereafter sufficient to heat and melt the second higher temperature melting metal alloy charge, whereby, upon said melting of said alloy charges, the sacrificial wall is dissolved to provide said passageway for the flow of the first eutectic metal alloy charge and the metal precipitate through the housing and into the well.

2. The well tool of claim 1, further comprising: plug means carried on said well tool at the lower end of said housing and positionable within said well for bridging said failure spots on said tubular conduit.

3. The well tool of claim 1 further comprising: plug means carried on said well tool at the lower end of said housing and positionable within said well for bridging said failure spots on said tubular conduit, said plug means including a circumferentially extending outer seal means for sealing the lowermost end of an annular area defined between the exterior of the plug means and the interior surface of the tubular conduit to prevent flow of the metal alloys below said annular area.

4. The well tool of claim 1 further comprising: valve means on the housing and operable to vent pressure within the chamber in the housing above a pre-determined pressure level, during ignition and burning of the fuel system.

5. A method of repairing failure spots using metal alloys along a section of a first tubular conduit within a subterranean well, comprising the steps of:

(1) introducing into well upon a conduit a tool comprising:

(a) an elongated housing having a cylindrical interior chamber and a lower end, said chamber being formed by first and second sections thereof, said housing having proximate its lower end a circumferentially extending dissolvable sacrificial wall means for initially isolating the chambers from the exterior of the housing and, upon melting of the metal alloys, providing a passageway through said housing to permit the metal precipitate to flow out of the housing and into the well;

(b) a first, lower temperature melting eutectic metal alloy charge deposited within one of the first and second sections of the chamber;

(c) a second, higher temperature melting metal alloy charge deposited within the other of the first and second sections of the chamber;

(d) means at one end of said housing for introducing, positioning and retrieving said tool within said well;

(e) an ignitable fuel system within said chamber;

(f) means for igniting the fuel system, whereby, upon activation of the igniting means, the fuel system is ignited sufficient to heat and melt the first lower temperature melting eutectic metal alloy charge and thereafter sufficient to heat and melt the second higher temperature melting metal alloy charge, whereby, upon said melting of said alloy charges, the sacrificial wall is dissolved to provide said passageway for the flow of the first eutectic metal alloy charge and the metal precipitate through the housing and into the well;

(2) straddleingly positioning the tool immediate the area of the section of the first tubular conduit including the failure spots;

(3) igniting the fuel charge to generate sufficient heat to sequentially melt the low temperature alloy and the high temperature alloy, whereby the passageway in the housing is opened to permit the high temperature alloy to first flow out of the housing and form a bridge into the well immediate the failure spots, and to secondly permit the low temperature alloy to flow out of the housing upon the bridge and into the well immediate the failure spot, to plug and cover the failure spots; and (4) withdrawing the well tool from within the well.

6. A method of repairing failure spots using a first metal alloy charge and a metal precipitate from a second metal alloy charge, along a section of a first tubular conduit within a subterranean well, comprising the steps of:

(1) introducing into the well a well tool, comprising:

(a) an elongated housing having a cylindrical interior chamber and a lower end, said chamber being formed by first and second sections thereof, said housing having proximate its lower end a circumferentially extending dissolvable sacrificial wall means for initially isolating the chambers from the exterior of the housing and, upon melting of the metal alloy charges, providing a passageway through said housing to permit the first metal alloy charge and the precipitate of the second metal alloy charge to flow out of the housing and into the well;

(b) the first, lower temperature melting eutectic metal alloy charge deposited within one of the first and second sections of the chamber;

(c) the second, higher temperature melting metal alloy charge deposited within the other of the first and second sections of the chamber;

(d) means at one end of said housing for introducing, positioning and retrieving said tool within said well;

(e) an ignitable fuel system within said chamber;

(f) means for igniting the fuel system, whereby, upon activation of the igniting means, the fuel system is ignited sufficient to heat and melt the first lower temperature melting eutectic metal alloy charge and thereafter sufficient to heat and melt the second higher temperature melting metal alloy charge, whereby, upon said melting of said alloy charges, a metal precipitate is formed from the second metal alloy charge and the sacrificial wall is dissolved to provide said passageway for the flow of the first metal alloycharge and the precipitate through the housing and into the well;

(g) plug means initially carried on said housing and selectively detachable therefrom for defining an annular area between the exterior of said plug means and the interior of said first tubular conduit when said tool is straddleingly positioned immediate said failure spots;

(2) straddleingly positioning the tool immediate the area of the section of the first tubular conduit including the failure spots;

(3) igniting the fuel charge to generate sufficient heat to sequentially melt the low temperature alloy and the high temperature alloy and form a metal precipitate from the high temperature metal alloy, whereby the passageway in the housing is opened to permit the metal precipitate formed from the high temperature alloy to first flow out of the housing and form a bridge into the well immediate the failure spots, and to secondly permit the low temperature alloy to flow out of the housing upon the bridge and into the well immediate the failure spot, to plug and cover the failure spots:

(4) applying an upward force upon the well tool to detach the plug means from the housing; and (5) retrieving the housing to the top of the well.

* * * * *